US007117602B2

(12) United States Patent
Saunders

(10) Patent No.: US 7,117,602 B2
(45) Date of Patent: Oct. 10, 2006

(54) SHOULDER PLANE

(75) Inventor: Terry R. Saunders, North Gower (CA)

(73) Assignee: Lee Valley Tools, Ltd., Ottawa (CA)

( * ) Notice: Subject to any disclaimer, the term of this patent is extended or adjusted under 35 U.S.C. 154(b) by 94 days.

(21) Appl. No.: 10/914,677

(22) Filed: Aug. 9, 2004

(65) Prior Publication Data

US 2005/0060897 A1 Mar. 24, 2005

Related U.S. Application Data

(60) Provisional application No. 60/494,316, filed on Aug. 11, 2003.

(51) Int. Cl.
*B27G 17/02* (2006.01)

(52) U.S. Cl. ..... 30/489; 30/482; 30/491; 30/492

(58) Field of Classification Search ..... 30/487–489, 30/482, 492, 491, 478, 340
See application file for complete search history.

(56) References Cited

U.S. PATENT DOCUMENTS

| | | | | |
|---|---|---|---|---|
| 274,600 | A | 3/1883 | Hegglund | |
| 306,877 | A | 10/1884 | Traut | |
| 781,771 | A | 2/1905 | Gardner | |
| 2,550,766 | A * | 5/1951 | Bryant | 30/487 |
| 6,615,497 | B1 * | 9/2003 | Saunders et al. | 30/488 |
| 2003/0037446 | A1 * | 2/2003 | Saunders et al. | 30/481 |

OTHER PUBLICATIONS

Lie-Nielsen Toolworks USA, *Bench Rabbet Plane*, Apr. 10, 2006, pp. 1-3, http://www.lie-nielsen.com/catalog.php?grp=1219.

* cited by examiner

*Primary Examiner*—Charles Goodman
(74) *Attorney, Agent, or Firm*—Kilpatrick Stockton LLP; John S. Pratt; Camilla C. Williams

(57) ABSTRACT

A plane such as a shoulder plane having at least two set screws positioned in apertures in the body, the set screws adapted to bear against opposite sides of the blade laterally to adjust the blade in position. An adjustment assembly is also provided, where rotation of a knob adjusts longitudinal movement of a traveler component, and laterally pivoting the knob allows lateral movement of the blade to the extent permitted by the set screws. A knob for rotational readjustment of the handle is also provided.

15 Claims, 6 Drawing Sheets

SHOULDER PLANE

CROSS-REFERENCE TO RELATED APPLICATIONS

This application claims priority to U.S. Provisional Patent Application Ser. No. 60/494,316 filed Aug. 11, 2003 entitled "Shoulder Plane," which is incorporated herein by reference.

FIELD OF THE INVENTION

This invention relates to shoulder planes and rebate or rabbet planes used in woodworking.

BACKGROUND

Planes generally include an adjustable blade and are used in woodworking to flatten and smooth a surface. Conventional planes use blades oriented at an angle (generally between about 12° and 45°) to the sole of the plane and, therefore, to the surface being worked.

When using a shoulder plane and cutting into a corner, it is critical to position the blade with the adjacent edge exactly parallel with or projecting slightly from the body on the working side. Traditional shoulder planes require a manual trial and error process to achieve optimal positioning. In addition, shoulder planes are, by nature, very difficult to hold and to manipulate, since no features can permanently project to either side of the body of the plane since one plane side usually registers against a workpiece during use.

Therefore, it would be beneficial to have a shoulder plane that is more easily handled and that has a blade that is more easily positioned.

SUMMARY

An improved shoulder or rabbet plane according to embodiments of this invention includes at least two set screws positioned in apertures in the body, the set screws adapted to bear against opposite sides of the blade laterally to adjust the blade position. An adjustment assembly allows rotation of a knob in order to adjust longitudinal movement of a traveler component that, in turn, controls blade projection, and lateral pivoting of the knob to allow lateral movement of the blade to the extent permitted by the set screws. A lever cap knob is repositionable. The lever cap knob is received in a channel and may be secured in any selected position along the channel by tightening the knob. The lever cap knob may be repositioned by loosening the knob and retightening it in another position along the channel. Therefore, the handle may be loosened, rotated and secured in a desired position. Alternatively, the lever cap knob may be removed from the plane entirely. In an alternative embodiment, a bullnose shoulder plane includes at least two set screws adapted to bear against opposite sides of the blade laterally to adjust the blade in position. The bullnose shoulder plane may be converted to a chisel plane by removal of the toe piece.

Thus, this shoulder plane improves on such conventional planes by providing structure for easily, accurately and reproducible establishing the lateral position of the cutting blade and by providing a knob for handling the plane in use that may be positioned to project from a wide variety of positions, including on either side of the plane while not obstructing needed contact between the plane and a workpiece or fence. Holes in the plane body sides further facilitate manipulation of the plane in use.

It is therefore one feature of this invention to provide a shoulder plane having a blade that is adjustable laterally.

A further feature of this invention is a shoulder plane having an adjustment assembly for adjusting longitudinal movement of the blade.

Another feature of this invention is a lever cap knob that may be rotated and secured in a desired position.

Yet another feature of this invention is a bullnose shoulder plane having a blade that is adjustable laterally and that is convertible to a chisel plane by removing the toe piece of the plane.

Yet another feature of this invention is a bullnose shoulder plane having a pocket adapted to receive a digit of a user of the plane.

DETAILED DESCRIPTION

Figure 1:
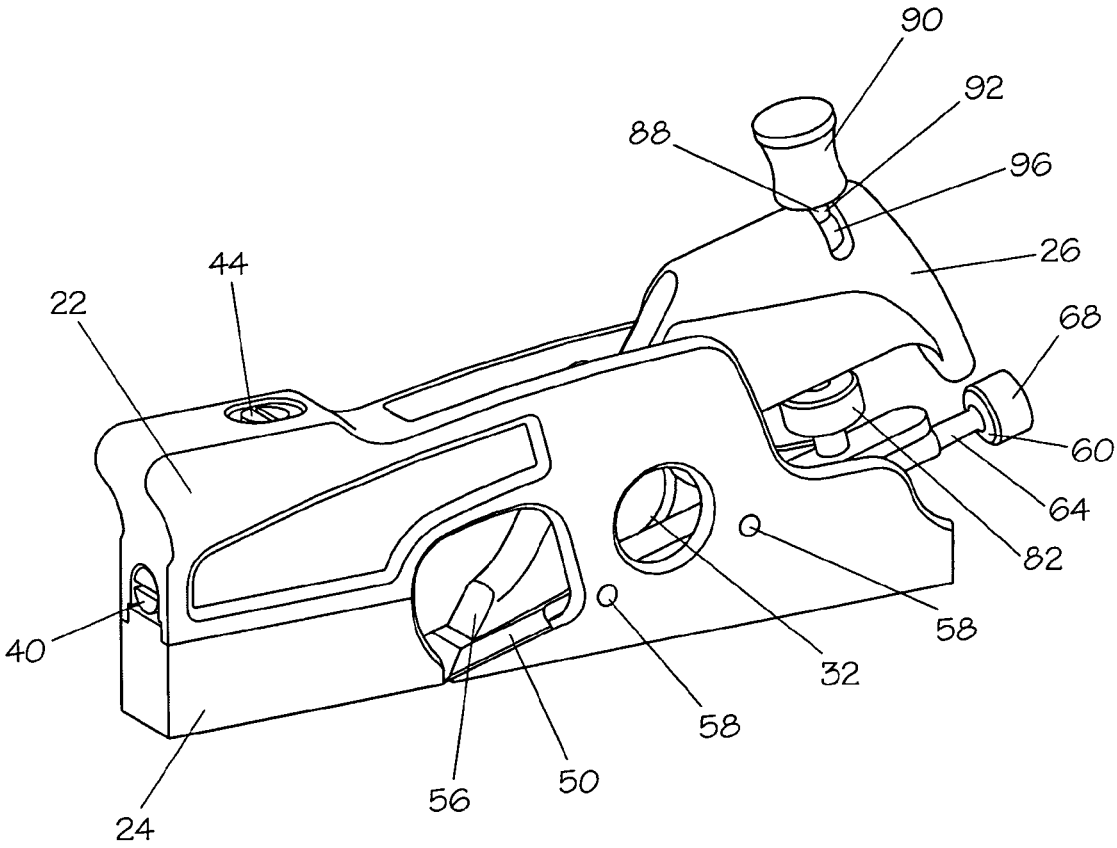
FIG. 1 is a perspective view of a first embodiment of the shoulder plane of this invention.
Figure 2:
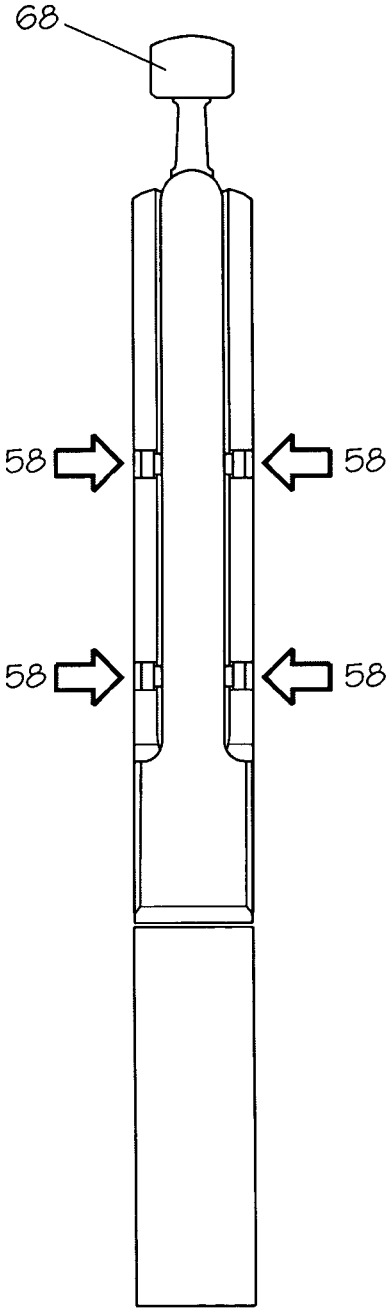
FIG. 2 is a top view of a portion of the body and the blade of the shoulder plane shown in FIG. 1, showing the relationship between the blade, the setscrews, and the sides of the plane body.
Figure 3:
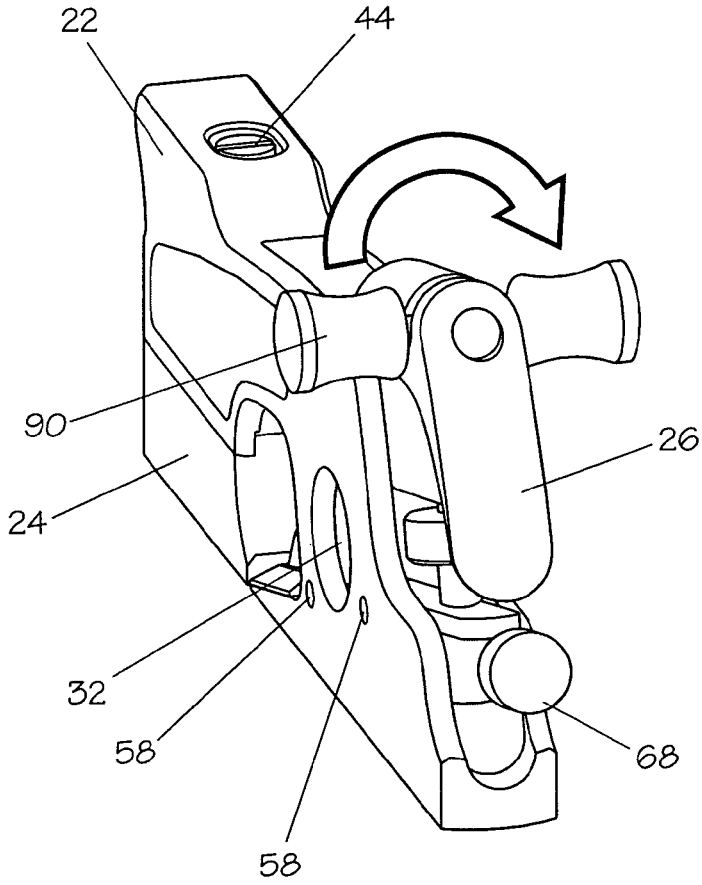
FIG. 3 is a perspective view of the shoulder plane shown in FIG. 1, showing the movement of the variable position knob.
Figure 4:
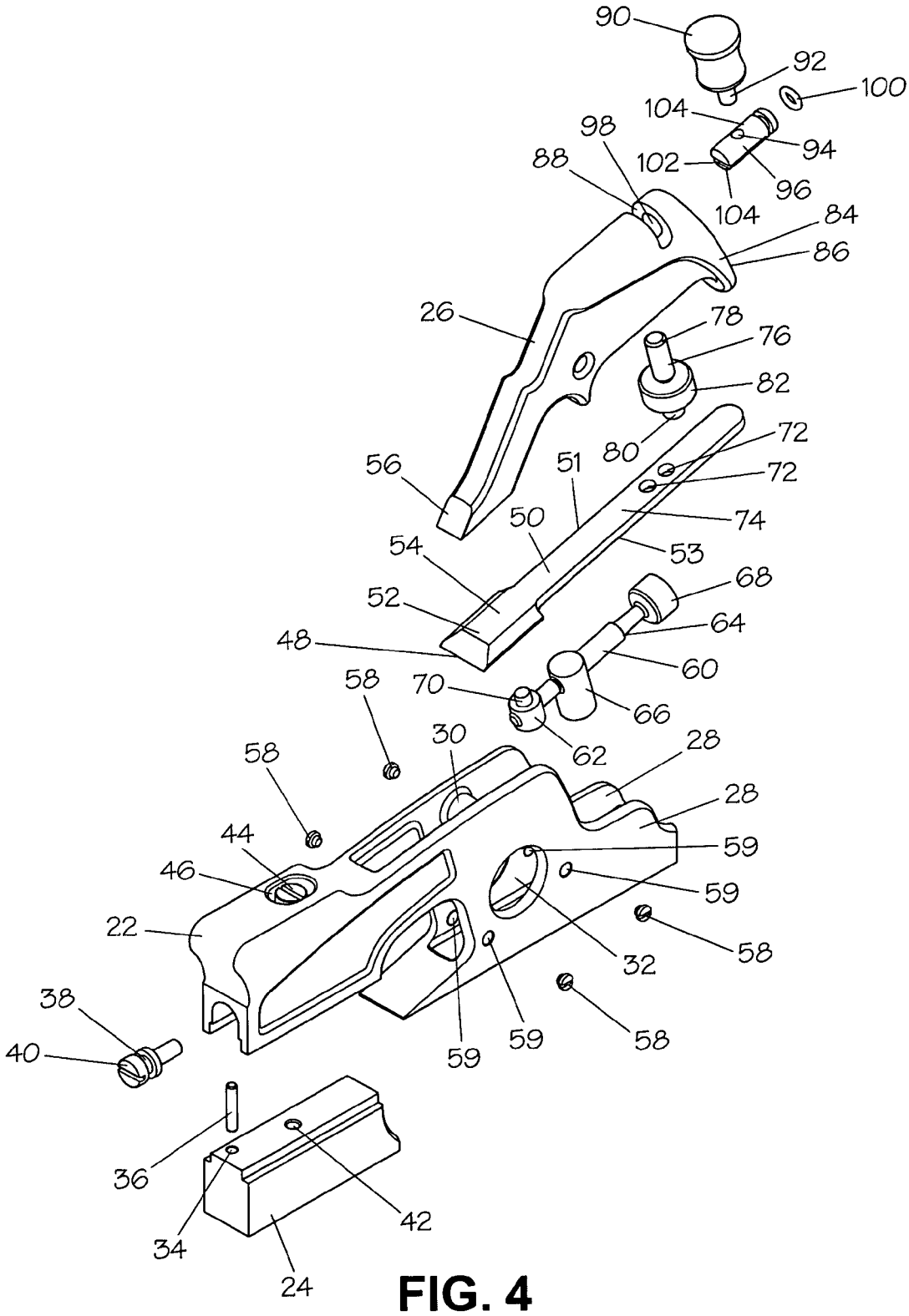
FIG. 4 is an exploded perspective view of the shoulder plane shown in FIG. 1.

As may be seen by reference to FIGS. 1–4, the shoulder plane 20 of this invention includes generally a body 22, a toe 24 and a lever cap 26. A brace 30 (see FIG. 3) is positioned between sides 28 of body 22. Handle apertures 32 in each side 28 of body 22 facilitate holding and manipulating the shoulder plane 20 during use.

Pin aperture 34 (visible in FIG. 3) on the top face of toe 24 receives dowel pin 36. The opposite end of pin 36 is captured in an annular depression 38 of toe adjustment screw 38, so that turning toe adjustment screw 40 in and out acts on dowel pin 36 to force toe 24 in or out. Screw aperture 42 on the top face of toe 24 receives toe locking screw 44, which passes through bore 46 in the top of the body 22 and into the screw aperture 42 on toe 24, securing toe 24 to body 22. Toe locking screw 44 may be loosened so that adjustments may be made to toe 24 by adjusting toe adjustment screw 40.

Cutting edge 48 of blade 50 is positioned between the toe 24 and body 22 at the sole or bottom surface of the shoulder plane 20. Cutting end 52 of blade 50 includes top surface 54 against which forward end 56 of lever cap 26 presses. Four adjustment setscrews 58 positioned in apertures 59 in body 22 to bear against opposite sides 51, 53 of blade 50, two on each side of the blade, are used to move the blade 50 laterally within body 22. After the setscrews 58 have been set, the setscrews 58 act as stops or locators that enable the blade 50 to quickly be re-set into position after removal for sharpening.

Adjustment assembly 60 includes traveler 62, which is located near the end of shaft 64 proximal to adjustment pivot 66 and opposite adjustment knob 68. Traveler 62 includes pin 70, which is received in one of pin holes 72 of arm 74 of blade 50. Shaft 64 is threaded through pivot 66 that is stationary within a bore in body 22. Rotating shaft 64 using knob 68 therefore causes traveler 62 to move longitudinally within body 22. Laterally pivoting knob 68 causes blade 50 to move laterally to the extent permitted by setscrews 58.

Lever cap rod 76 includes threaded end 78 which is received in threaded opening (not visible) in lever cap 26. The opposite end 80 of the rod 76 is smooth, with a knurled wheel 82 positioned between the two ends. End 80 of rod 76 bears against blade 50, and rotating wheel 82 exerts force separating the lever cap 26 and blade 50 to lock both in the body 22.

Lever cap 26 secures the blade 50 in position. Rear end 84 of lever cap 26 includes a smooth, generally flat palm surface 86 that may be used as a handle. An additional, adjustable handle is provided by lever cap knob 90. Knob 90 is positioned on a shaft 92 that extends through a slot or channel 88 in the lever cap 26 and is threaded into a lever cap pin 96 positioned in a bore 98 transverse to the slot 88. The knob shaft 92 of the lever cap knob 90 is received in the shaft hole 94 of the lever cap pin 96. Forcing lever cap pin 96 into pin housing 98 compresses o-ring 100, which provides resistance to rotation of cap pin 96, thereby maintaining a position of knob 90 to which pin 96 is rotated. Pin 96 includes slot 102, which divides pin 96 into two legs 104. Threaded hole 94 does not extend into the second of the legs 104. Rotating knob 90 screws knob shaft 92 into hole 94 and against the second of the legs 104, forcing the legs 104 of pin 96 apart, thereby locking the pin 96 in position within frog 26.

Lever cap knob 90 may be secured in any selected position along channel 88 by tightening knob 90 and repositioned by loosening the knob 90 and retightening in another position along the channel 88. As may be seen by reference to FIG. 3, lever cap knob 90 thus provides a handle that can be loosened, rotated and secured in the desired position, which is typically away from the working face. Lever cap knob 90 may also be removed from the plane entirely when there is no usable position for it.

The body 22 and toe 24 may be made from ductile cast iron, or any other suitable material. The blade 50 may be made from A2 tool steel or any other suitable material. The toe locking screw 44 and the toe adjustment screw 40 may be made from stainless steel, or any other suitable material. The lever cap 26 may be made from zinc aluminum alloy (ZA12), or any other suitable material. The lever cap knob 90, pin 96 and adjustment knob 68 may all be made from brass or any other suitable material. The shaft 64, pivot 66 and traveler 62 of the adjustment assembly 60 may be formed from steel, or any other suitable material. While the shape of knob 90 shown is one that functions well, other shapes could also be utilized.

Figure 5:
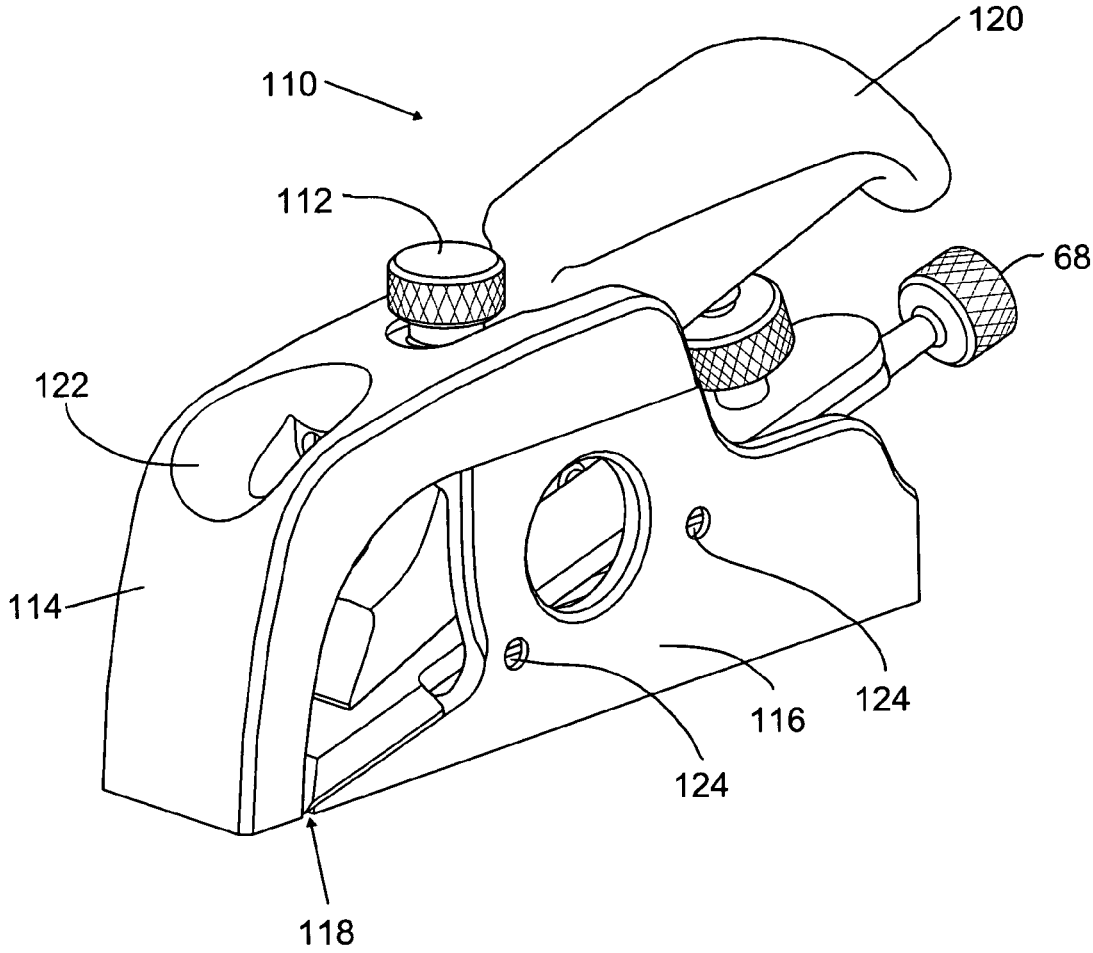
FIG. 5 is a perspective view of an alternative bullnose embodiment of the shoulder plane of this invention.
Figure 6:
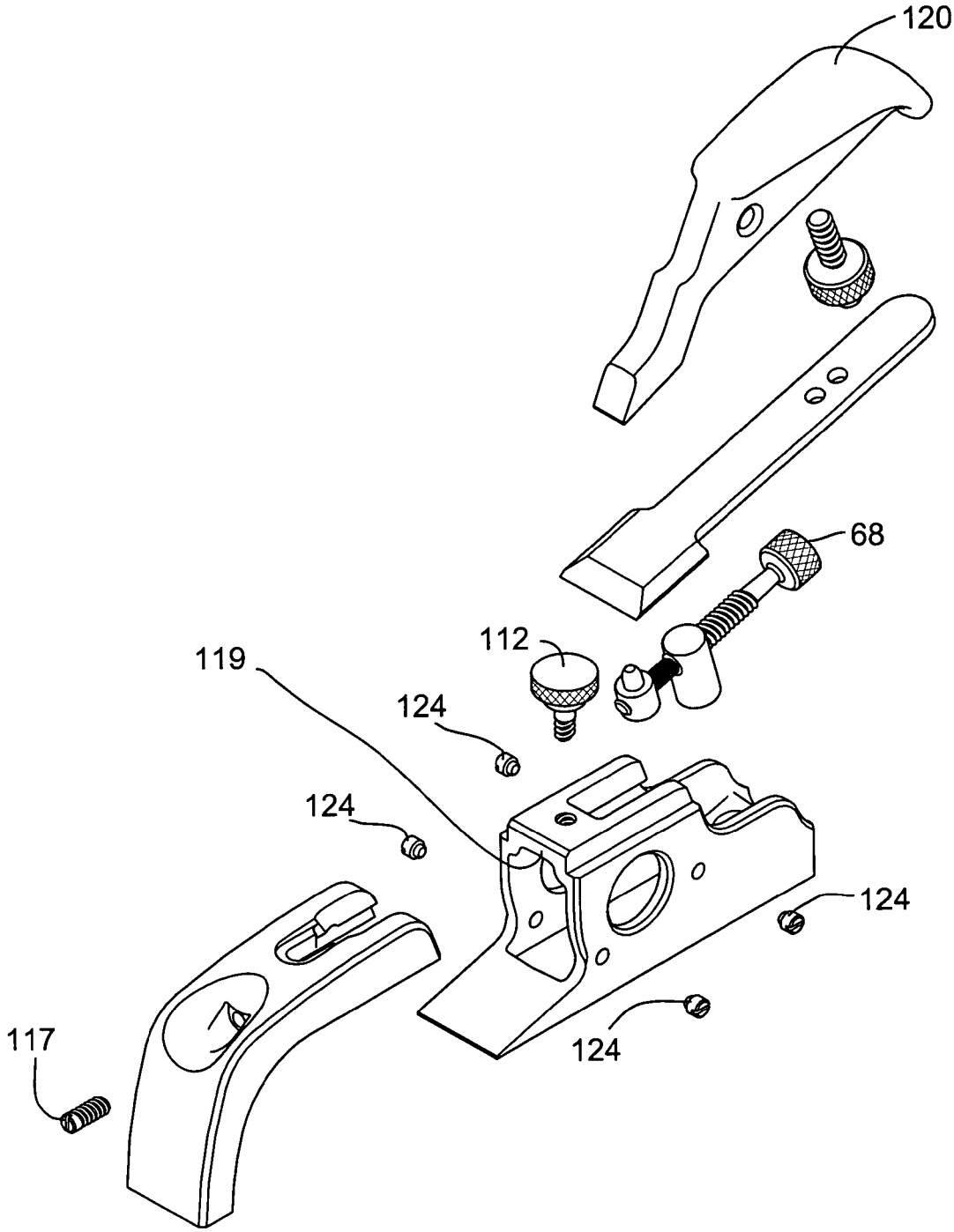
FIG. 6 is an exploded perspective view of the plane of FIG. 5.
Figure 7:
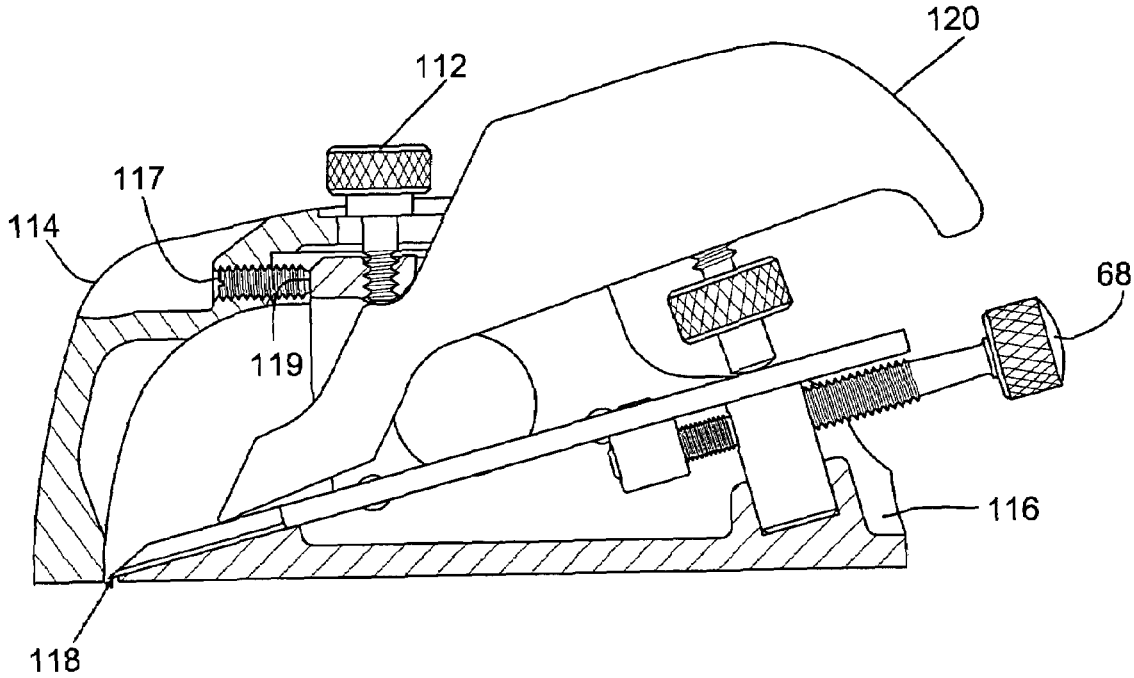
FIG. 7 is a side view in partial cross section of the plane of FIG. 5.

FIGS. 5–7 illustrate an alternative embodiment, a bullnose shoulder plane 110. Bullnose shoulder plane 10 will perform as either a bullnose or a chisel plane, as required. In one embodiment, shown in FIG. 5, the toe locking knob 112 may be loosened to remove the toe piece 114 for chisel plane configuration, allowing use up to a blind corner. The toe piece 114 may be replaced by sliding the toe piece onto the body 116 and under the toe locking knob 112 until it stops at the previously set mouth opening position, which is controlled by set screw 117 that contacts body 116 at contact point 119. The adjustable toe provides the ability to narrow the mouth 118 for very fine shavings with minimum tear-out.

This bullnose embodiment is shaped to fit comfortably in the user's hand. The low, broad lever cap 120 is adapted to be received in the palm of the hand, and the forefinger rests in the toe pocket 122, providing improved control and enhancing ease of use. One benefit of this embodiment is that removal of the toe piece 114 does not affect the handling of the device, as only the toe piece 114 is removed, rather than any other part of the plane, such as the broad lever cap 120.

As described above with reference to FIGS. 1–4, set screws 124 in bullnose plane 110 provide accurate positioning of the blade and allow replacement after sharpening without lateral adjustment.

A bullnose shoulder plane according to this invention can measure 4⅓;4" long by 1" wide and weigh just over 1⅓;4 lb, but other sizes and weights are possible. In the embodiment described in the preceding sentence, the blade may be ⅛" (0.125") thick and made of A2 tool steel hardened to Rc60-62. The body and toe of the bullnose shoulder plane may be formed from ductile cast iron and machined and ground so that the sole and sides are flat and square, allowing the plane to be used on its side.

In the shoulder plane of this invention, a low bed angle of 15° may be combined with a 25° blade bevel, resulting in a cutting angle of 40°.

As will be appreciated by those skilled in the art, this invention can be practiced in numerous alternative embodiments in addition to those shown in the drawings and described above without departing from the spirit of this invention or the scope of the following claims.

The invention claimed is:

1. A shoulder plane comprising:
(a) a shoulder plane body having a low bed angle and a width,
(b) a blade positioned bevel up on the bed and having a first portion proximate a cutting arris and equal in width to the body width and a narrower second portion remote from the first portion, and
(c) four set screws positioned in apertures in the body, the set screws adapted to bear against opposite sides of the blade and adapted laterally to adjust the blade in position, wherein two of the set screws bear against each of the two opposite sides of the narrower second portion of the blade.

2. The plane of claim 1, wherein the set screws act as locators that enable the blade to be re-set into position after removal.

3. The plane of claim 1, further comprising an adjustment assembly comprising
(a) a knob,
(b) a traveler having a pin adapted to be received in an aperture in an arm of the blade,
(c) a stationary pivot, and
(d) a shaft adapted to pass through the pivot, wherein rotation of the knob rotates the shaft, causing the traveler to move longitudinally within the body of the plane, and wherein laterally pivoting the knob causes the blade to move laterally.

4. The plane of claim 1, wherein the shoulder plane is a bullnose shoulder plane.

5. The plane of claim 4, further comprising a toe piece and a lever cap, wherein the bullnose shoulder plane is convertible to a chisel plane by removing the toe piece but not the lever cap.

6. The plane of claim 5, further comprising a toe locking knob for securing the toe piece to the plane body.

7. The plane of claim 5, wherein the lever cap secures the blade in position.

8. The plane of claim 4, further comprising a pocket having a rounded opening on the body adapted to receive a digit of a user.

9. The plane of claim 1, further comprising lever cap for securing the blade to the body and a removable handle attached to the lever cap comprising a lever cap knob, wherein rotating the knob permits it to be removed or attached and secured in a plurality of selected positions relative to the lever cap.

10. The plane of claim 9, further comprising a channel in the lever cap adapted to receive the lever cap knob and wherein the lever cap knob is repositionable along the channel.

11. The plane of claim 1, further comprising an adjustable handle secured to the lever cap.

12. The plane of claim 1, further comprising an adjustable toe.

13. A shoulder plane comprising:

(a) a shoulder plane body having a low bed angle and a width, and having apertures adapted to receive set screws, (b) a blade equal in width to the body width and positioned bevel up on the bed, (c) four set screws adapted to laterally adjust position of the blade;

(d) a lever cap for securing the blade in the body and comprising a lever cap knob; and (e) a removable handle attached to the lever cap wherein rotating the knob permits it to be removed or attached and secured in a plurality of selected positions relative to the lever cap.

14. The plane of claim 13, wherein the lever cap further comprises a channel adapted to receive the knob.

15. The plane of claim 14, wherein the knob is repositionable along the channel.

* * * * *